US005865990A

United States Patent [19]

Novak et al.

[11] Patent Number: 5,865,990

[45] Date of Patent: Feb. 2, 1999

[54] METHOD AND APPARATUS FOR SORTING GRAIN

[75] Inventors: Thomas Joseph Novak, Kingwood; Kaizar Hashim Colombowala, Katy, both of Tex.; Robert Otto Brandt, Jr., Wilmington, N.C.

[73] Assignee: Uncle Ben's, Inc., Houston, Tex.

[21] Appl. No.: 713,702

[22] Filed: Sep. 13, 1996

[51] Int. Cl.[6] ..... B07C 5/00

[52] U.S. Cl. ..... 209/579; 209/580; 209/588; 209/639

[58] Field of Search ..... 209/579, 580, 209/581, 582, 588, 639, 644

[56] References Cited

U.S. PATENT DOCUMENTS

| | | | |
|---|---|---|---|
| 1,031,669 | 7/1912 | Twamley . | |
| 3,197,647 | 7/1965 | Fraenkel | 250/225 |
| 3,871,774 | 3/1975 | Murata | 356/201 |
| 3,956,636 | 5/1976 | Williams | 250/572 |
| 4,161,366 | 7/1979 | Bol et al. | 356/56 |
| 4,196,811 | 4/1980 | Pilesi et al. | 209/588 |
| 4,466,544 | 8/1984 | Satake et al. | 209/580 |
| 4,572,666 | 2/1986 | Satake | 356/239 |
| 4,666,045 | 5/1987 | Gillespie | 209/585 |
| 4,713,781 | 12/1987 | Brizgis | 364/552 |
| 4,752,689 | 6/1988 | Satake | 250/339 |
| 4,806,764 | 2/1989 | Satake | 250/339 |
| 5,245,188 | 9/1993 | Satake et al. | 250/341 |
| 5,448,069 | 9/1995 | Tobler et al. | 250/339.01 |
| 5,487,472 | 1/1996 | Satake et al. | 209/588 X |
| 5,505,313 | 4/1996 | Smith et al. | 209/579 |
| 5,524,746 | 6/1996 | Massen et al. | 198/443 |

*Primary Examiner*—David H. Bollinger
*Attorney, Agent, or Firm*—Fulbright & Jaworski L.L.P.

[57] ABSTRACT

The present invention sorts imperfect grains from perfect grains using a chute having a grain separating section, a cross section to orientate the grains, and a grain stabilizing section; a laser with a laser line transmitted through the grains; a photo detect or and processor to receive and analyze the light transmitted through the grains to determine which grains are imperfect; and a separator to separate the perfect and imperfect grains.

23 Claims, 10 Drawing Sheets

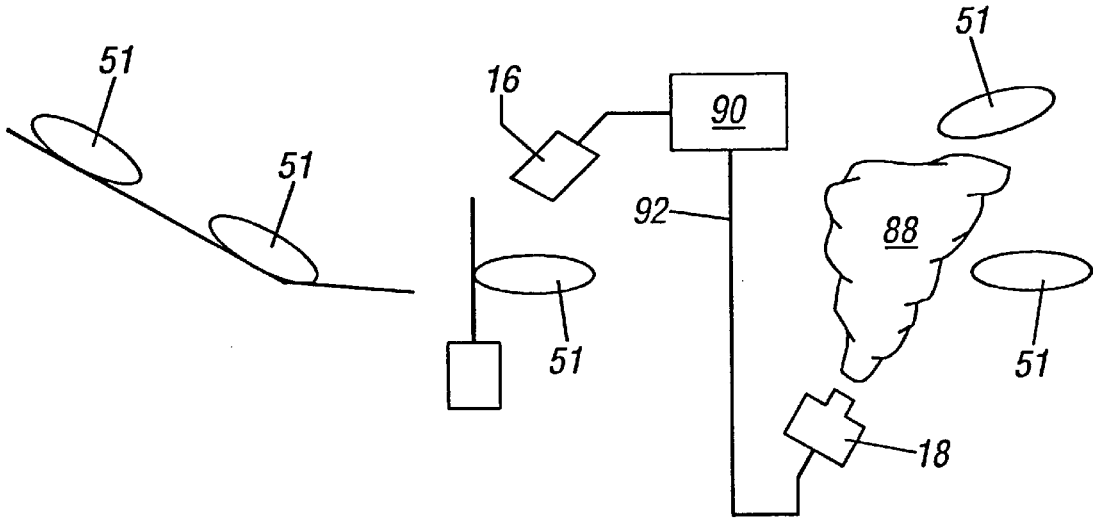
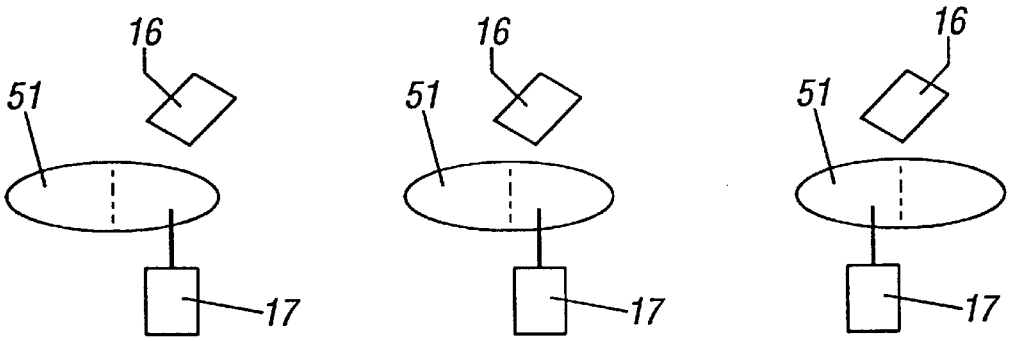
FIG. 8
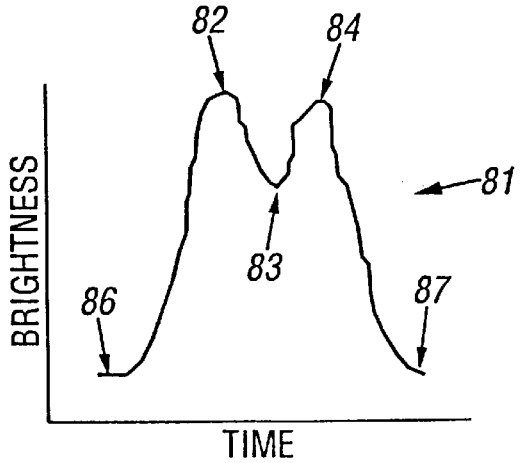

FIG. 16

| ROW | DERIVATION OF ROW | DESCRIPTION OF VALUE OR COMPULATION | VALUE |
|---|---|---|---|
| A | DATA | TOTAL LOT % BROKENS FORMED USING STANDARD USDA TEST MILLING PROCEDURE, MILLED BASIS, WT. % | 23.8% |
| B | A/100 | PARTS OF BROKENS FORMED IF TOTAL LOT IS WHITE MILLED (CONVERTED TO WEIGHT FRACTION OF FEED) | 0.238 |
| C | TYPICAL RESULT | % EJECTED AS WHOLE UNDEFECTIVE KERNELS, AS A WT. PERCENT OF THE FEED | 60.0% |
| D | DATA | % BROKENS IN THE EJECTED FRACTION, AFTER WHITE MILLING | 4.1% |
| E | C x D | PARTS OF BROKENS IN THE EJECTED FRACTION, AS A WEIGHT FRACTION OF THE FEED | 0.024 |
| F | 100% - C | % NOT EJECTED AS A WEIGHT PERCENT OF THE FEED | 40.0% |
| G | TYPICAL RESULT | % BROKENS IN THE NOT EJECTED FRACTION AFTER PARBOILING AND MILLING | 6.9% |
| H | F x G | PARTS OF BROKENS FORMED IN THE NOT EJECTED FRACTION AFTER PARBOILING AND MILLING (AS A WEIGHT FRACTION OF THE FEED) | 0.028 |
| I | E + H | PARTS OF BROKENS FORMED IN BOTH FRACTIONS (WHITE MILLED EJECTED AND PARBOILED/MILLED NOT EJECTED AS A WT. FRACTION OF THE FEED) | 0.052 |
| J | (B - I)/B x 100 | % AVOIDANCE IN TOTAL OVERALL BROKENS FORMALION | 78.1% |
| K | DATA | % PECK IN THE FEEDSTOCK ROUGH RICE | 1.00% |
| L | DATA | % PECK IN THE EJECTED PORTION | 0.12% |

METHOD AND APPARATUS FOR SORTING GRAIN

FIELD OF INVENTION

The invention relates to a method and apparatus for separating internally cracked, discolored, chalky or otherwise imperfect grain from internally whole, properly colored, non-chalky or otherwise more perfect grain.

BACKGROUND OF THE INVENTION

In the rice milling industry, whole grain yield is highly valued. A broken grain is worth half or less in the marketplace compared to a whole grain. Also, a small difference in the amount of broken grains level in the milled rice will significantly lower its quality grade. As such, broken grains are removed from milled rice and sold off at a lower price.

The milling industry consists of two general types of rice mills: white rice mills and parboiled rice mills. In a white rice mill the rough rice is dehulled and milled, along with numerous mechanical cleaning and defect separation operations. In a parboiled rice mill, the rough rice is steeped in hot water, steamed, dried, dehulled and milled, along with numerous mechanical cleaning and defect removal operations. Parboiling has several advantages for improving the rice's cooking quality and milling yield.

For a white rice miller, brokens in milled rice are in part caused by imperfect grain structure. These are immature grains, chalky grains and internally cracked grains in rough rice. Immature grains are underdeveloped, are generally thin and break easily. Chalky grains have milk-white or opaque centers and are sometimes called white bellies. Chalkiness is caused by the presence of air or due to less dense packing of starch in the endosperm. It is soft and also breaks easily. Cracked kernels are caused by either over drying prior to harvest, uncontrolled moisture adsorption or desorption, mechanical harvest damage, or by some other post harvest damage. Rapid or uncontrolled moisture change causes mechanical stress in the rice kernel. If the stress exceeds the tensile strength of the kernel, a crack or check is the result. For parboiled rice millers, neither chalk nor cracked grains cause breakage as they are almost completely healed during the hydro-thermic processing. Thus, parboiled rice millers have a whole kernel yield advantage over white rice millers. This disadvantage could be eliminated, if the white rice millers could obtain crack and chalk free rice for milling.

The following disclosures are related to the sorting process used in the present invention. Massen, et al., U.S. Pat. No. 5,524,746, discloses an apparatus for sorting bulk rice using an optical monitor to detect grains of different color or luminosity or grains of different size or shape that travel on a conveyor belt. When the optical monitor detects an imperfect rice grain, a jet of air from a nozzle removes the grain from the conveyor belt. Satake, et al., U.S. Pat. No. 5,245,188, discloses an apparatus for evaluating the grade of rice grains using grooved chutes in which the individual grains fall through past a light source. Detectors measure both the reflected and transmitted light from each grain and determine if the grain is complete, scratched or discolored. Inferior grains are sucked from the grooved chutes and removed through a different outlet. Satake, U.S. Pat. No. 4,806,764, discloses an apparatus for evaluating the quality of rice grains using an infrared spectrometer with a band-pass filter and detectors for measuring reflected light to measure the content percentages of pre-selected constituents, such as protein, amylose, amylopectin, and moisture. From the various content percentages, quality evaluation values are determined. Satake, U.S. Pat. No. 4,752,689, is related to the previous patent except that it prints or displays the actual percentage contents of constituents. Gillespie, et al., U.S. Pat. No. 4,666,045, discloses a pit detection apparatus and method for fruit sorting using a sweeping transmission scanning beam with sensors and a sizing beam with sensors. Pits are detected from analyzing the amount of light transmitted through the fruit at various points in the fruit. Fruit with pits are then removed by an ejector valve. Satake, U.S. Pat. No. 4,572,666, discloses an apparatus for detecting cracked rice grains in hulled or unhulled grains using a chute or conveyor belt, a light source, and two light detectors. Cracked grains are determined by comparing the amount of light transmitted through leading half part of an inspected grain to its trailing half part. Based on the grain's position, less light will be transmitted through one-half of a cracked grain in comparison to the other half. Pilesi, et al., U.S. Pat. No. 4,196,811, sorts buttons by measuring the amount of light transmitted through each button as it travels down a chute. Murata, U.S. Pat. No. 3,871,774, detects cracks in unhulled grains by irradiating the grain with a laser and measuring the light transmitted through the grain which is conveyed through the laser beam. The amount of light transmitted through the grain decreases when a crack is scanned. The patent does not disclose a method to sort the grains, a laser line, a means to separate grains for detection, a grain stabilizing means, or any features to make the invention commercially efficient. Fraenkel, U.S. Pat. No. 3,197,647, sorts white from red rice by measuring the light transmitted through each grain. Twamley, U.S. Pat. No. 1,031,669, tests the maturity of corn kernels by transmitting light through the kernels. Brizgis, et al., U.S. Pat. No. 4,713,781, analyzes damaged grain by illuminating a grain with long wave, ultraviolet radiation, causing the exposed starch of the damaged section to fluoresce. The amount of fluoresce determines the amount of damage to the grain.

With the conventional apparatus or methods disclosed above, it is not possible to sort internally cracked unhulled grains from internally whole unhulled grains in a commercially efficient manner for use by rice millers. For commercial purposes, the evaluation of unhulled grains must be done quickly with minimum error. In the previously disclosed art, a rice grain travelling at a high velocity may not be properly stabilized when it is analyzed because air resistance and other factors may oppose the natural grain orientation. If the grain is wobbling, a structural defect may not be detected. The prior art also does not disclose adequate methods for separating each grain prior to analysis. Additionally, the lasers used to analyze objects in the previously disclosed art are typically focused to the smallest spot size possible and do not illuminate some defects that are not precisely positioned. Also, the photo detection systems used do not provide a strong signal for better resolution of the signal. With a commercially efficient sorting invention, unhulled rice could be separated into two fractions: internally whole and internally defective unhulled grains. Then, white rice millers could process the internally whole unhulled grains for a higher yield and would pay a premium price for the internally whole unhulled grain. The internally defective unhulled grains—which would have resulted in broken rice for the white rice millers—can be used by parboilers for processing.

SUMMARY OF THE INVENTION

The present invention overcomes the limitations of the prior art and discloses an apparatus for sorting imperfect grains from perfect grains. The invention includes a chute with a separation section, a cross section for properly orientating the grains, and a stabilizing section; a laser with a laser line transmitted through grains after the grains have been separated, orientated and stabilized; a photo detector and processor to receive and analyze the light transmitted through the grains to determine which grains are imperfect; and a separating means connected to the processor to separate perfect and defective grains.

The present invention also contains a method for sorting imperfect grains from perfect grains with the steps comprising aligning the grains in the chute; creating distance between individual grains in an inclined chute; stabilizing grains in the chute with centripetal force for optical detection; optically analyzing the grain with a laser line and producing an output; determining from the output of the optical analysis if the grain is perfect or imperfect; and separating the imperfect grains from the perfect grains.

The above described inventions can be utilized for sorting unhulled grains, including unhulled rice grains; for sorting brown rice; for sorting internally cracked grains from internally whole grains; for sorting discolored grains from properly colored grains; and for sorting chalky grain from non-chalky grain. The transmitted light can be detected using a photo detector and the grains can be physically separated by removing certain grains from the path with a blast of air. The photo detector can also utilize a large aperture and a plurality of lenses.

BRIEF DESCRIPTION OF THE DRAWINGS

The embodiments will now be described with references made to:

FIG. 8 shows the operation of the detection and separation system.

FIG. 16 shows the results of a test run on rough rice using the method of this invention.

DESCRIPTION OF THE PREFERRED EMBODIMENT

Figure 1A:
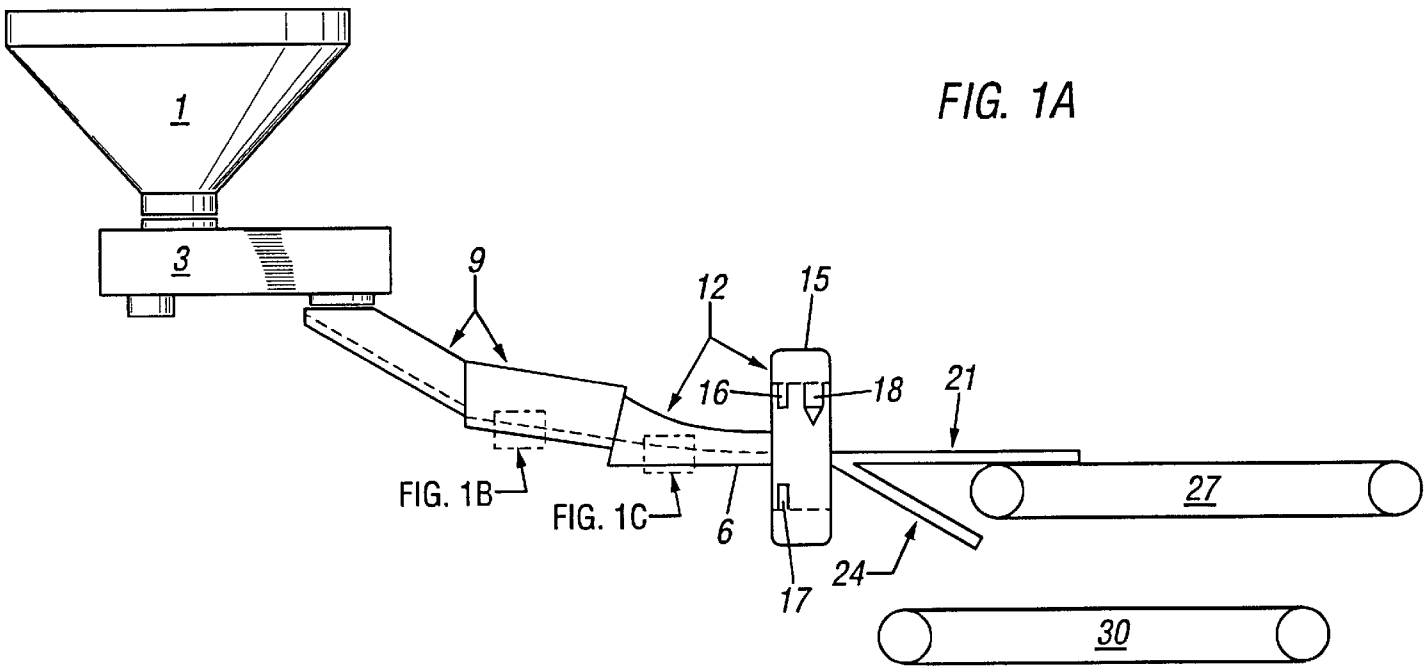
FIG. 1A shows an overview of the claimed invention.
Figure 1C:
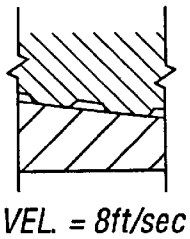
FIG. 1B and 1C show expanded views of sections from the invention.
Figure 1B:
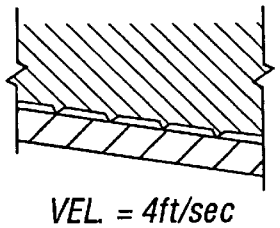

As shown in FIG. 1A, grain in a hopper 1 is dispensed into a vibratory feeder 3 where grain is carried to singulation channels 9. Individual grains will drop from the vibratory feeder 3 into the singulation channels 9 where the grains are separated into chutes that are narrow enough to only accommodate one grain at a time. The grains are aligned end to end as shown in FIG. 1B. The apparatus and method for feeding grain into single grain chutes is well known in the industry.

After the grains have been separated into single grain chutes, the grain moves into the present claimed invention 12. The grains initially pass through one of the chutes in a series of parallel chutes 6. In the chutes 6, the individual grains are separated from one another (as shown in FIG. 1C), in each chute by a dual angle section of the chutes 6. The grooves properly orientate the grains for optical analyses. A curved portion of the chutes 6 stabilizes the grains with centripetal force When the grains are properly separated, orientated and stabilized, the grain leaves the chute and is optically examined by the detection and separation system 15 which utilizes laser 17 and photo detector 16. The rejected grains are then removed by a blast of air from nozzle 18. The grains are analyzed and rejected while airborne. Grains that are blown off course are directed toward path 24 from where the rejected grains are conveyed away by conveyor 30. The accepted grains are not blown off course by nozzle 18 and are transported along path 21 from where they are conveyed away by conveyor 27.

Figure 2:
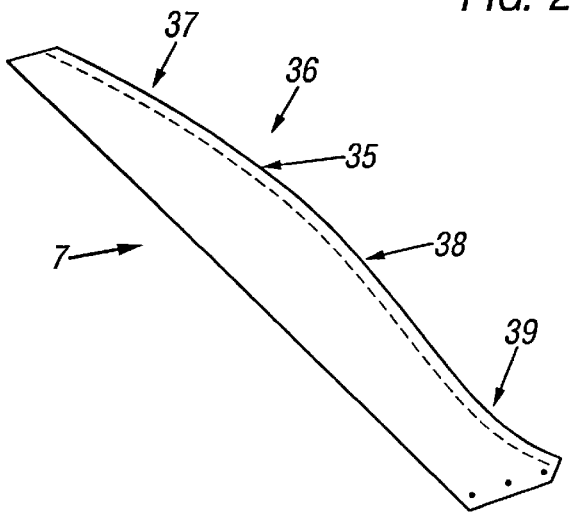
FIG. 2 shows a side profile of the chute.

A profile of a single chute 7 of the parallel series of chutes 6 is shown in FIG. 2. The chute 7 has an upper acceleration section 36 and a lower radial grain stabilizing section 39. Acceleration section 36 is positioned at an angle level to the floor between 30 to 60 degrees. The acceleration section 36 contains two angled sections 37 and 38 to separate the grains passing along the acceleration section 36. The first angled section turns into a steeper angle with relation to the floor at bend 35. Grains fall from the first angled section 37 at bend 35 onto second angled section 38. The grain falling onto second angled section 38 use gravity to accelerate away from the next grain on chute 7. The grains must be properly separated to be analyzed. A preferred embodiment is a separation of about one grain length which is approximately equal to a range between 1.5 to 2.5 milliseconds between grains passing through the detection and separation system 15. However, one skilled in the art knows that this time will vary depending on the performance limits of the grain ejector, the photo detector used, the processor used, and other limits or variables. The time or distance between grains is set in part by the angles of sections 37 and 38 given a certain friction between the grain and chute. The friction depends in part upon the chute coating, the type and shape of grain used, and the velocity of the grain.

Figure 3:
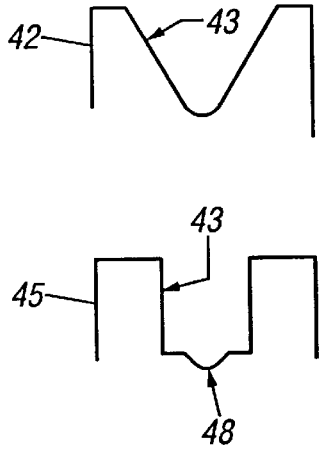
FIG. 3 shows cross sections of the chute.

The stabilizing section 39 of chute 7 solves the problem encountered in optically analyzing fast moving grains. A grain placed on a flat level surface has a natural orientation based on the grain geometry. For example, a rice grain tends to orient itself so that the length of the grain is parallel to the chute path. When sliding down a conventional conveyor at low velocities, the grain keeps it's natural orientation. A conventional conveyor is typically positioned at an angle level to the floor in excess of 45 degrees. The conveyor may have a channel, such as a H, V, or U channel, to guide the grain orientation. At high velocities air resistance, momentum, and other factors oppose the natural grain orientation. Cross sections of a channel 42 and an H channel 45 with lower grove 48 is shown in FIG. 3. For example, a rice grain sliding at a high velocity may not remain in the proper orientation. When grains lose their natural orientation in the channel, it creates a problem for the optical or electronic sensor. The problem is solved by using a curved conveyor as show in the stabilized section 39 of chute 7 in FIG. 2. To keep any object moving in a circle, a force must be supplied pulling the object inward toward the center. A force pointed radially inward is a centripetal force. The curved conveyor exerts a centripetal contact force on the grain. This force causes the grain to lie flat in its natural orientation without wobbling on the stabilizing section 39 of chute 7 even at high velocities.

Because the grain is stabilized by the stabilizing section 39, the grain can be launched from the chute 6 before the grain is optically analyzed. Prior art requires high velocity grains to be analyzed while still in a chute because the grains were not stable enough to be launched into mid air before analysis. The prior art typically analyzed the grain while passing over a window or slot in the chute. However, dirt, dust, and other particles can clog or block the window or slot. When the window or slot is blocked, optical analysis is either hindered or prevented. Launching a stable grain into mid air for analysis is better for accuracy and preventing maintenance shut downs.

The chute 7 also has a coating 43 to establish a certain friction and to reduce wear on the chute by passing grain. A preferred embodiment uses an anodized teflon coating on an aluminum chute. The coating provides a low coefficient of friction to facilitate movement of grain along the chute. The coating also protects the chute from wear and tear. Fast moving grain is abrasive on any surface it passes over. An aluminum chute would have a short life span due to the abrasive environment unless it was coated with a protecting layer. A chute can be constructed using a harder material, but it is cheaper to fabricate the shape and grooves of the chute with aluminum and then coat it. Other coatings can be used, such as ceramics, that prevent wear and reduce friction.

The chute 7 also uses certain channel shapes to properly orientate the grains, as illustrated in FIG. 3. A preferred embodiment of the chute 7 uses a V-shaped channel 42 in the upper portion of the chute 7 and an H shaped channel 45 in the lower portion of chute 7. The V shaped channel 42 is used to orientate the grains so that the length of the grain runs parallel to the direction of the chute. The H shaped channel 45 is used to orientate the grain so that the grain's belly is in the channel's groove 48. This position assures that any crack in the grain will be properly exposed to the laser.

Figure 4:
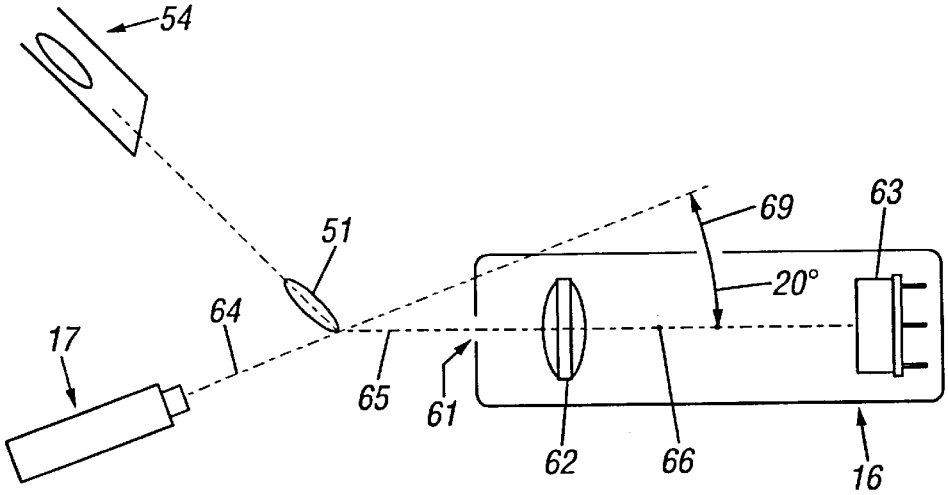
FIG. 4 shows the operation of the optical detection system utilizing a single lens.

After the grain is properly separated, orientated and stabilized for analysis, the detection and separation system 15 optically analyzes the grain. As shown in FIG. 4, laser 17 directs a laser beam 64 toward a passing grain 51. The laser light transmits through grain 51 and towards photo detector 16. To prevent the laser from saturating the detector, the photo detector needs to be placed at a certain angle 69 and at a slight offset with respect to the laser beam 64. A preferred embodiment of angle 69 is about 20°, but may vary upon the object being analyzed and the laser being used. The transmitted light 65 enters into photo detector 16 through slit 61 and through a lens 62 with a focal line 66. The width of the slit 61 should be smaller than the width of a defect in the grain being analyzed. The length of the slit 61 should be at least one and one-half to two and one-half rice units wide or about two-tenths of an inch wide. The lens 62 shown in FIG. 4 is a double-convex lens. A photodiode detector 63 is positioned to receive the transmitted light 65 passing through lens 62. The slit 61 limits the detecting view of the photodiode detector 63. Note that any other suitable means for transmitting and detecting light can be used besides the laser and photodiode detector shown.

Figure 5A:
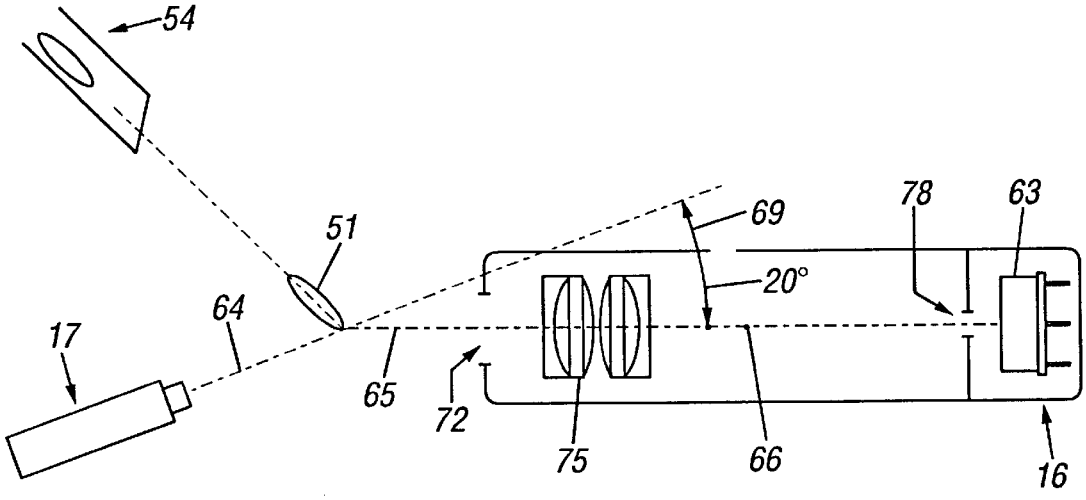
FIG. 5A and 5B show a optical detection system similar to the one in FIG. 4, but with a doublet lens and a larger aperture.
Figure 5B:
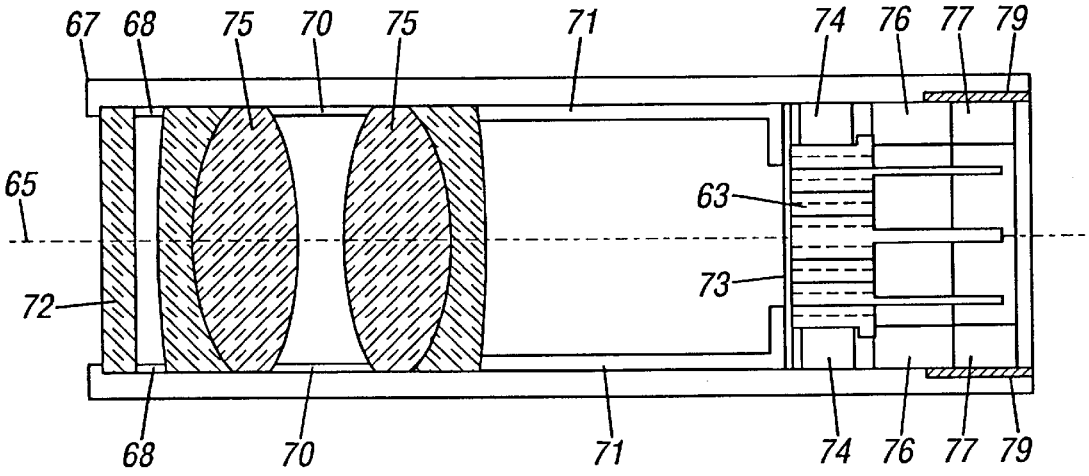

The design of the sensor in FIGS. 5A and 5B improves the signal strength received by processor 90 without having to electronically enhance the signal. The transmitted light 65 passes through a larger aperture 72 which is approximately 12.5 millimeters. The larger aperture allows approximately twenty times more light to reach the photodiode detector 63 which increases the signal strength proportionately. The plurality of lenses 75 better focus the increased amount of light onto the detector 63 through slit 78. Slit 78 limits the detecting view of the detector 63. The slit 78 in FIG. 5A is located between the lenses 75 and the detector 63 while the slit 61 of FIG. 4 is in front of the lens. Spacers 68 hold the window of aperture 72 in place. Spacers 70 hold the plurality of lenses 75 in place. Spacers 71 separate the lenses 75 and the detector 63 while spacers 74 and 76 hold the detector 63 in place. Threading for retainer 79 and retainer 77 also hold detector 63 in place.

Figure 6:
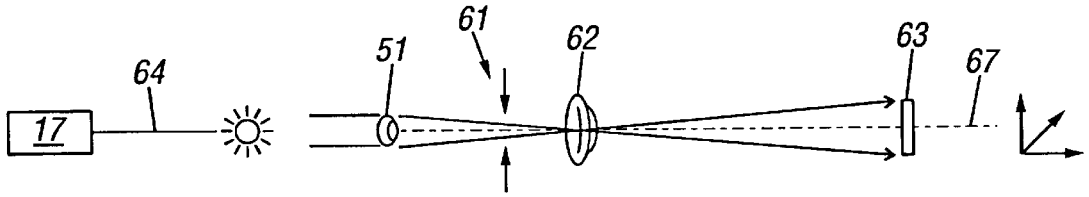
FIG. 6 shows the optics involved with laser beam analysis.
Figure 7:
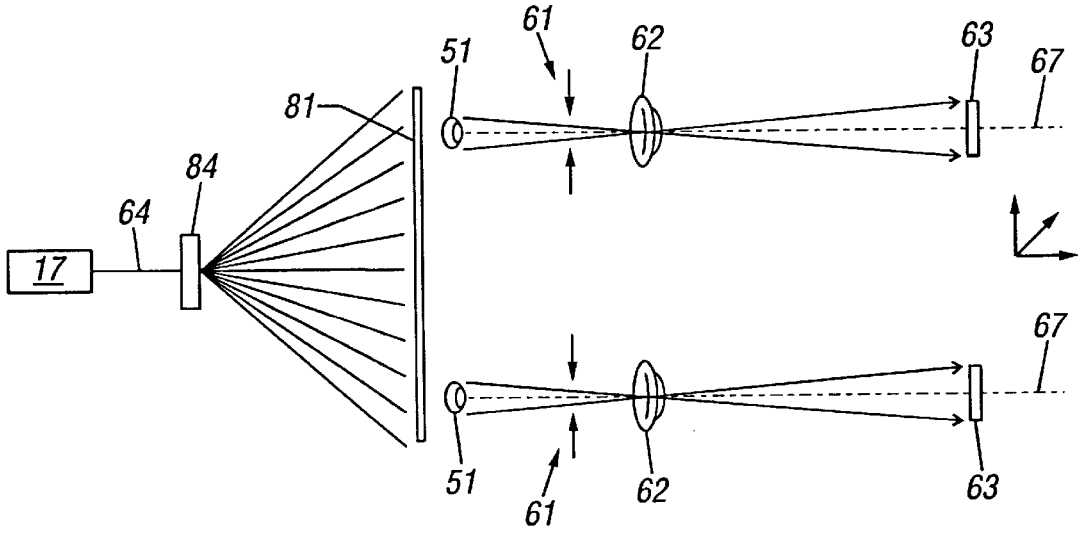
FIG. 7 shows the optics involved with laser line analysis.

The present invention utilizes a laser line 81 instead of a laser beam 64 as shown in FIGS. 6 and 7. The concept of a laser beam illuminating grain in order to examine the light that is transmitted through the grain is known. Cracks in the grain and other features can be detected using this method. The laser beam is typically focused to the smallest spot size possible. However, the object must be positioned precisely in order for the laser beam to illuminate the object. If the object is more than half of it's height (±½ h) off the optical axis 67 along the z-axis, then the laser beam will not illuminate the object. Therefore, the presentation tolerance in the z-axis is limited by the object's height. This limitation is solved by replacing the laser beam 64 with a laser line 81. The laser line is generated using cylindrical lenses 84. The use of a laser line also permits a single laser to illuminate multiple grains 51 at the same time. The width of the laser line should be smaller than the defect or crack in the grain, for example, approximately five-thousandths of an inch for rice. The length of the line should completely cover grain passing through the laser line 81 at a normal to the line and accommodate for any side-to-side movement by the grain.

The method by which detection and separation system 15 operates is illustrated by FIG. 8. The laser 17 transmits light through grain 51 as previously explained. The photo detector 16 receives the defracted light which transmits through grain 51. The photo detector 16 is connected to processor 90 by connection 91. The photo detector 16 sends signals to processor 90 through connection 91 which depends upon the amount of light received by photo detector 16. Processor 90 records the brightness of the light transmitted through grain 51 as a function of time. Graph 81 illustrates what the processor 90 records when a grain 51 contains a crack in its middle. When the laser beam is not transmitted through a grain, the laser light is not defracted towards photo detector 16 and a low level of light is registered at point 86. As a grain passes through laser beam 64 or laser line 81, the transmitted light 65 is defracted towards photo detector 16 and a certain brightness level 82 is recorded. When the laser beam 64 or laser line 81 passes through a crack, the transmitted light 65 will be defracted at a different angle or scattered angles and the photo detector will not receive as much transmitted light as shown by point 83. As a crack passes by the laser beam 64 or laser line 81 and a whole portion of the grain is analyzed, the photo detector 16 registers a higher brightness level as shown by point 84. When the grain passes the laser beam 64 or laser line 81, the brightness registered by photo detector 16 will once again drop to a point 87. If a whole grain passes through detection and separation system 15, then photo detector 16 should see an approximately constant brightness and would not see a drop in brightness like point 83.

Figure 9:
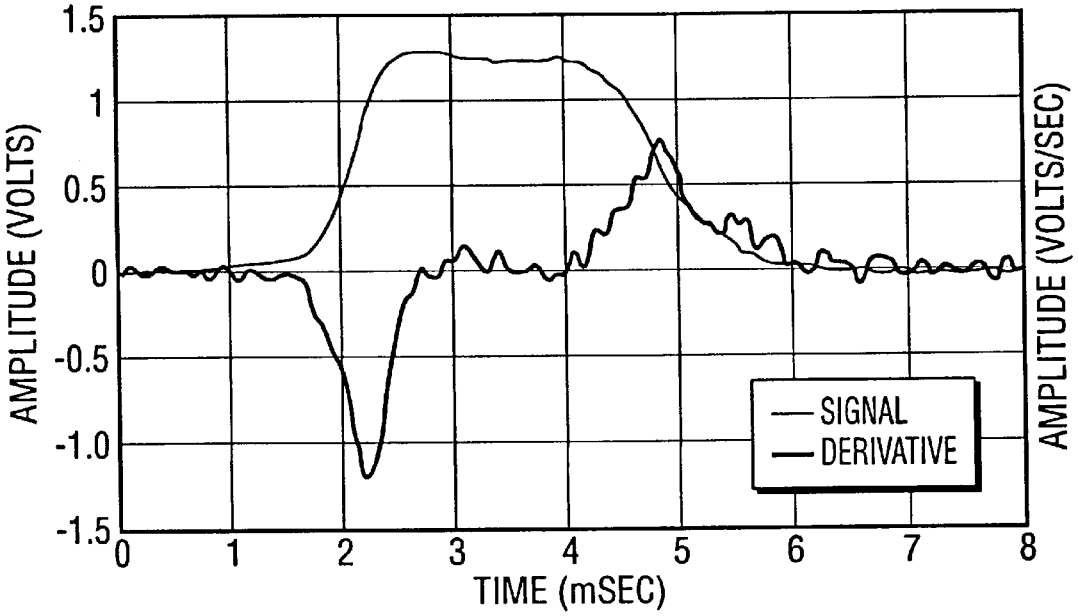
FIG. 9 shows the signal and derivative of a whole rice grain.
Figure 10:
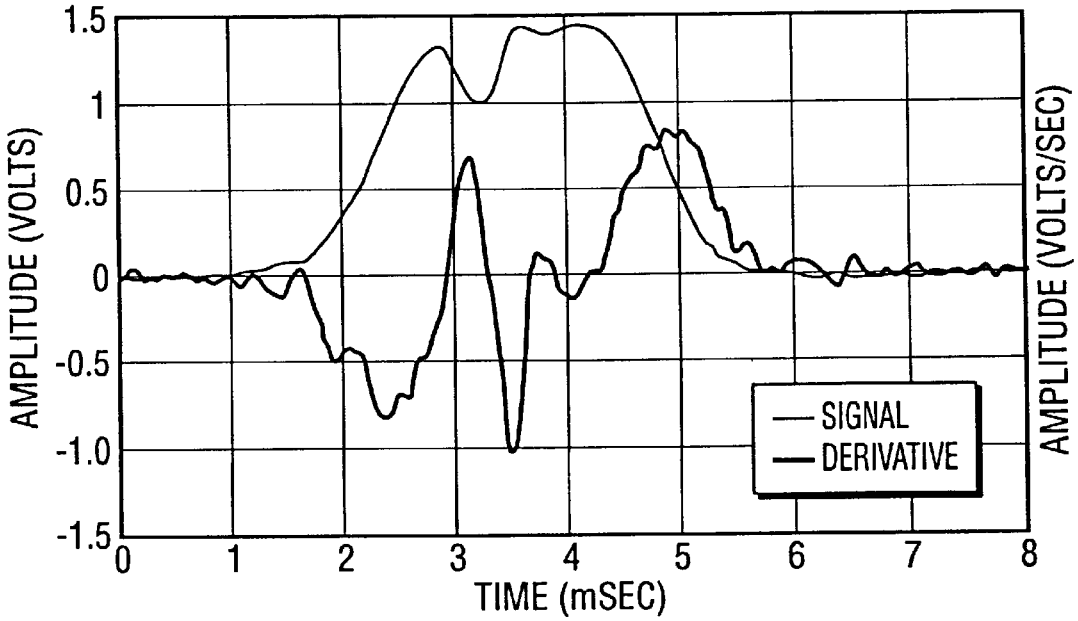
FIG. 10 shows the signal and derivative of a cracked rice grain.
Figure 11:
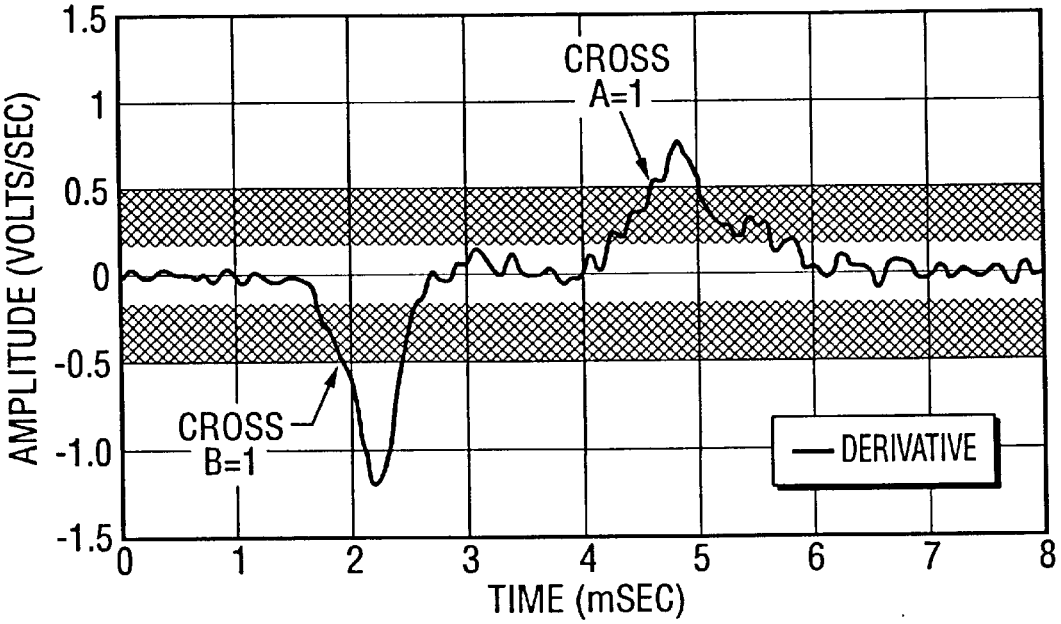
FIG. 11 shows the threshold crossing analysis of a whole rice grain.
Figure 12:
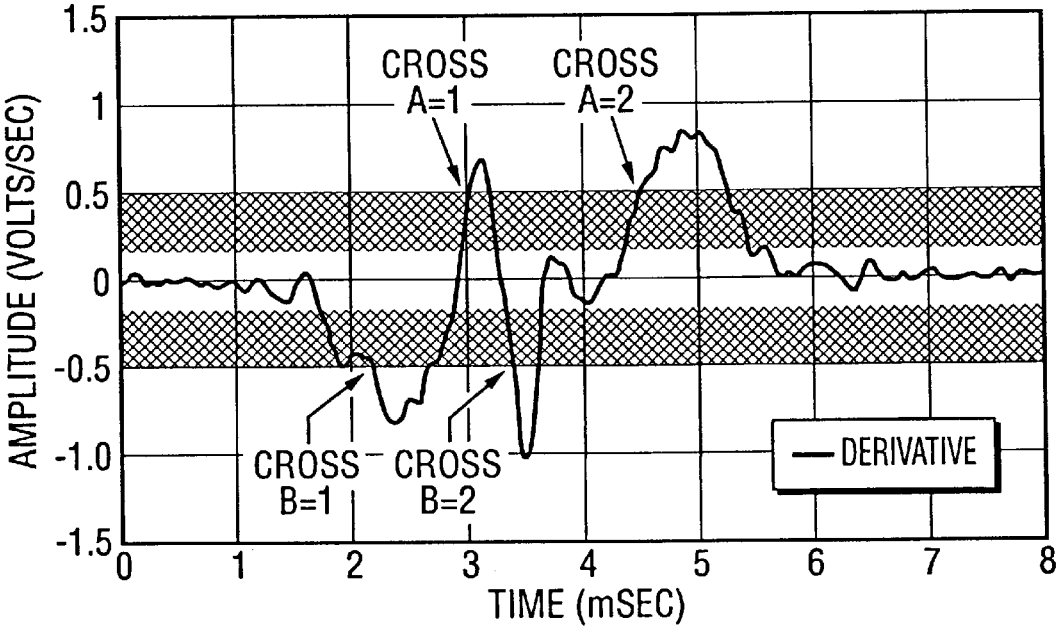
FIG. 12 shows the threshold crossing analysis of a cracked rice grain.
Figure 13:
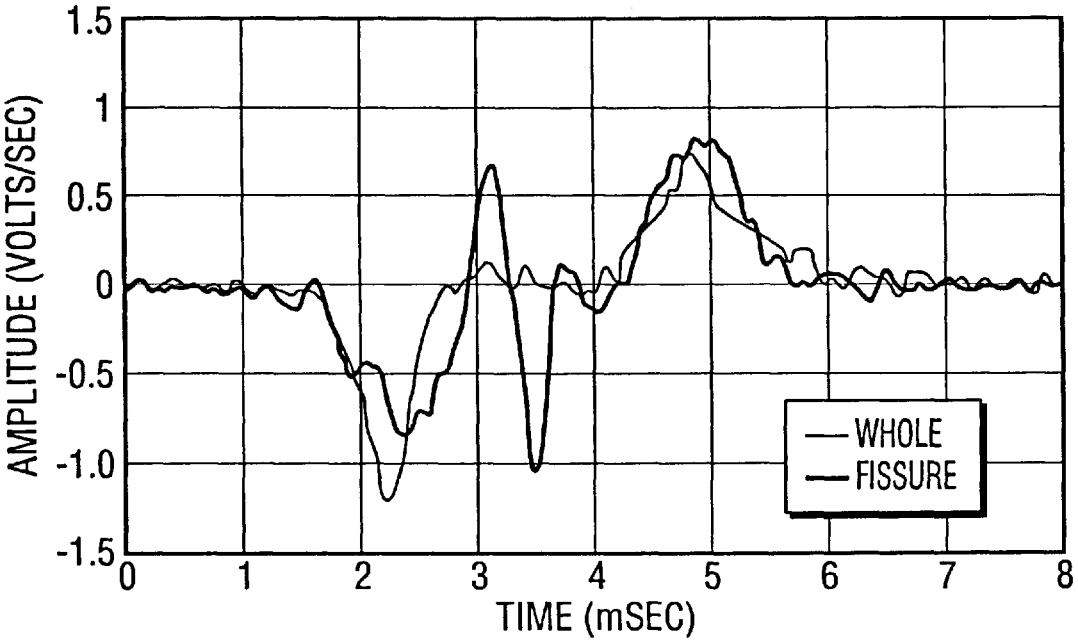
FIG. 13 shows a signal comparison between a whole and cracked grain.

Processor 90 determines from the brightness received by photo detector 16 if the grain 51 is internally cracked on internally whole. The processor 90 takes the derivative of the brightness as a function of time and compares the derivative to certain threshold points to categorize the grain 51. FIGS. 9 and 10 show the comparison between the signal and the derivative of a whole and cracked grain, respectively. FIGS. 11 and 12 show the threshold levels for the derivative of brightness for a whole and cracked grain, respectively. FIG. 13 shows a comparison of derivative signals between a whole and cracked grain. The threshold amounts will depend upon the intensity of the light transmitted through a grain.

When the processor 90 determines that a grain is internally cracked, the processor 90 signals the nozzle 18 through connection 92 to release a blast of air 88 at the appropriate time to jettison the grain 51 from the path and onto rejected path 24. Note that the processor 90 could also signal nozzle 18 to blast whole grains onto path 24. Any other method known in the art for separating the perfect grains from the imperfect grains can be used. In addition, the grains could be directed onto other conveyor belts or pathways that lead to further process steps.

Figure 14:
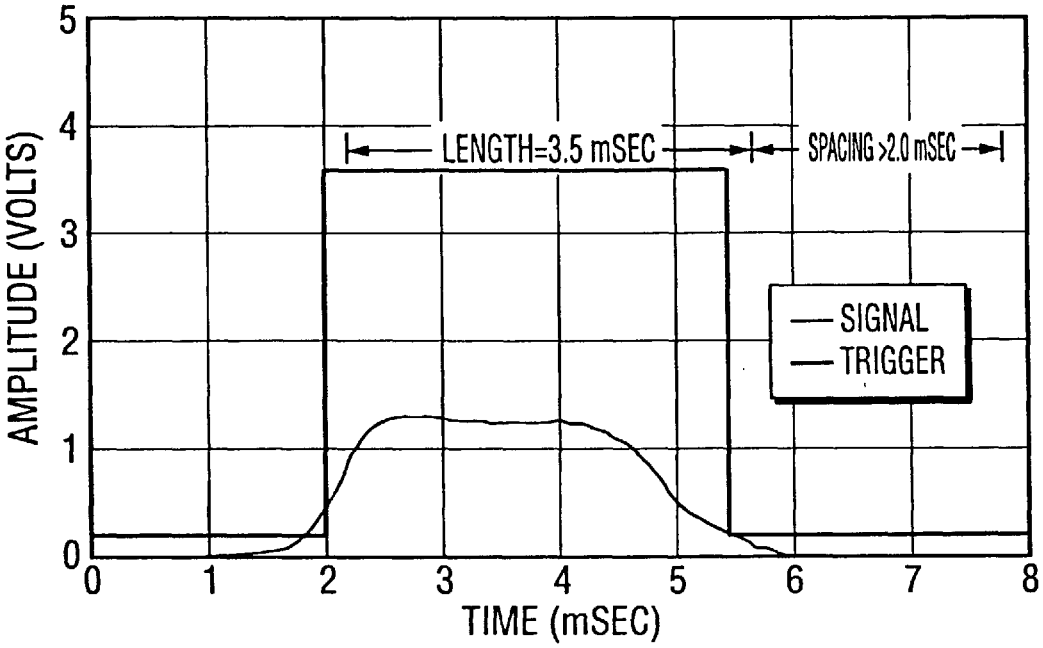
FIG. 14 shows a length and spacing analysis of a whole rice grain.

The present invention can also determine the length of grains and the spacing between grains. As shown in FIG. 14, the length of time which photo detector 16 registers a certain threshold level is indicative of the grains length. The actual length is determined using the known velocity of the grain passing through photo detector 16. The time between grains passing through detection and separation system 16 indicates the spacing between grains.

The present invention was primarily intended to be used on unhulled grains, especially to separate internally cracked unhulled grains from internally unhulled whole grains. After separating the cracked and uncracked grains, the internally cracked unhulled grains can be used for parboiling and the internally whole unhulled grains can be used for white rice milling. White rice millers would be willing to pay a premium for internally whole grains because it would result in lower production costs. At the same time, parboilers can utilize the internally cracked unhulled rice that the white rice millers would not want. Additionally, this process allows white rice millers to use certain varieties of rice that they normally would not use. Certain varieties of rice have high field yields, but high percentages of structural defects. The structural defects result in poor milling yield, giving high brokens in final white rice product. With the current invention, parboilers could use the structurally defective grains from high field yield rice and white rice millers can use the internally whole or structurally sound grains.

The invention can also be used on grains with their husks removed. Grains may have their husks removed and then stored for periods of time before processing. The grains can develop cracks during storage. These internally cracked grains can be removed before processing using the present invention.

The present invention can also be used on chalky rice. Rice can have uneven densities of starches within the grain. The varying densities are structural defects and are prone to breaking during milling. These structural defects can be analyzed and the grain rejected in much the same way the internal cracks are analyzed. The varying densities within the chalky grains defract and transmit light. From the amount of light transmitted through the grain to a photo detector, a processor can determine if the grain has such a structural defect.

Figure 15:
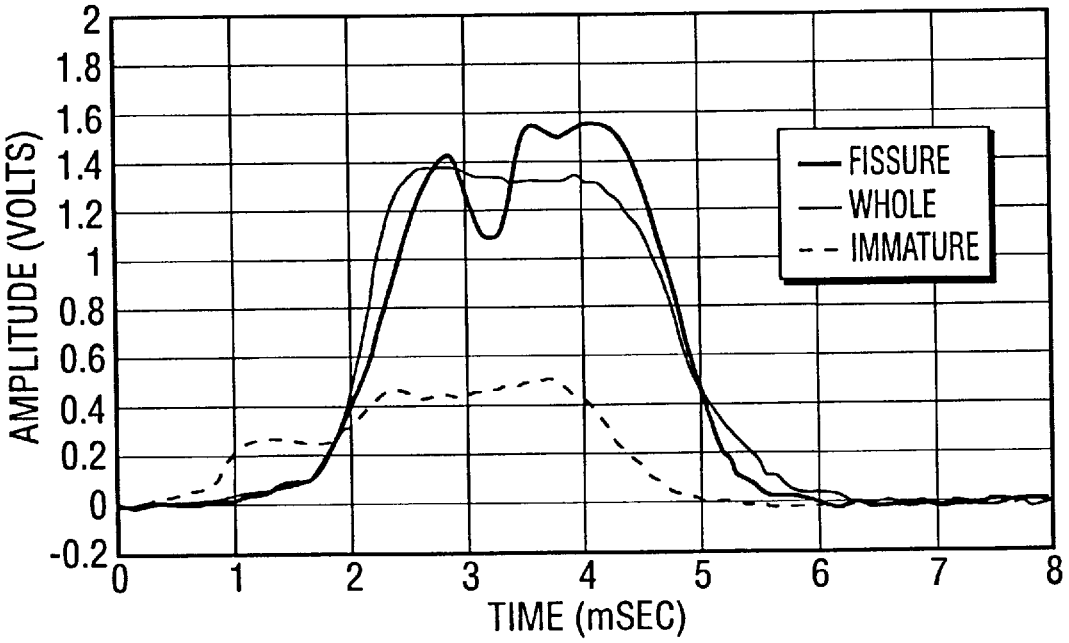
FIG. 15 shows a signal comparison between whole, cracked and immature rice grains.

The present invention can also be used to separate out other types of imperfect hulled or unhulled grains. For example, immature grains will have a lower brightness than a mature grain as illustrated by FIG. 15. By setting up different thresholds, processor 90 could eject an immature grain with nozzle 18. Similarly shelled grain, peck, smut, red rice, stack burnt rice, and seeds could be removed using the same invention. Processor 90 would need to be reprogrammed for each imperfect grain with different thresholds regarding brightness received by photo detector 16 and the amount of time certain thresholds are met.

The following provides an example of the benefit of this invention. FIG. 16 shows the results of a test run on rough rice using the method of this invention. All brokens values are on a weight percent milled basis. All weight fractions are based on the feed as a normalized value of 1.00. Row A of FIG. 16 shows the measured broken grain value for the as-is sample after white milling (no parboiling). Row B simply converts the weight percent of Row A to a weight fraction. Row C shows the typical percentage of rough rice kernels ejected during sorting in which the sorter is set to eject whole non-defective grains. Row D shows the measured broken grain value for the ejected non-defective kernels after white rice milling. Note that the level of brokens after white milling is significantly decreased from an incoming feed value of 23.8% to 4.1% for the ejected fraction. By this reduction alone it is very surprising in that very low brokens formation during white rice milled can be achieved comparable to brokens levels achieved during conventional paddy parboiling. Row E converts the brokens level after white milling in the ejected kernels portion to a weight fraction of the incoming rice. The importance of this value will be evident later in this example. Row F shows the percentage of incoming rough rice kernels not ejected which are analyzed as defective and structurally weak, thereby easily broken if not parboiled. If this portion was to be white milled without parboiling, a very high brokens value would result. Row G shows the weight percent brokens in the non-ejected portion after having been paddy parboiled and milled. Row H converts the brokens level after parboiling and milling to weight fractions of the incoming rice. Row I adds-together the weight fractions of brokens in both the ejected and non-ejected streams (Row E and H). Row J calculates the percentage avoidance of brokens where total white milling is the basis and the method of this invention is the improvement. 78% of brokens can be avoided in a milling scheme where 60% of the rice is white milled and 40% of the rice is paddy parboiled, on the ejected and non-ejected streams, respectively. Using the method of this invention it is therefore now possible to conduct white milling without suffering high brokens levels.

We claim:

1. An apparatus for sorting imperfect grains from perfect grains, comprising:

a chute defining a path for said grains, said chute having a cross-section orientating said grains, said chute having a separation section creating space between said grains on said chute, said chute having a stabilizing section, said chute having an end;

an analyzing area for analyzing said grains;

a light means having a laser line, said laser line being transmitted through said grains passing through said analyzing area;

a light detection means being positioned to receive said laser line transmitted through said grains;

an analyzing means for determining perfect and imperfect grains, said analyzing means being coupled to said light detection means; and a separating means for sorting imperfect grains from perfect grains, said separating means being coupled to said analyzing means.

2. The apparatus of claim 1 wherein said light means comprises a laser, a cylindrical lens being positioned in the path of a laser beam from said laser and said laser line extending from said laser beam after passing through said cylindrical lens, said laser line being transmitted through said grains passing through said analyzing area.

3. The apparatus of claim 1 wherein said light detection means comprises:

an outer shell defining a slit, said slit being positioned to receive said laser line transmitted through said grains into said outer shell;

at least one lens having a focal point, said lens being positioned inside said outer shell for receiving said laser line passing through said slit and for focusing said laser line at said focal point; and a photo detector being positioned inside said outer shell at said focal point.

4. The apparatus of claim 1 wherein said light detection means comprises:

an outer shell defining a front aperture and an interior slit, said front aperture being positioned to receive said laser line transmitted through said grains into said outer shell, said slit being positioned to receive said laser line transmitted through said grains and through said front aperture;

at least one lens having a focal point, said lens being positioned inside said outer shell between said front aperture and said slit for directing said laser line transmitted through said grains and said front aperture through said slit and for focusing said laser line at said focal point; and a photo detector being positioned inside said outer shell at said focal point.

5. The apparatus of claim 1 wherein said separating means comprises an air nozzle for blowing either imperfect grains or perfect grains out of said analyzing area.

6. The apparatus of claim 1 wherein said imperfect grains comprise internally cracked unhulled grains and said perfect unhulled grains comprise internally whole unhulled grains.

7. The apparatus of claim 6 wherein said grains comprise rice.

8. The apparatus of claim 1 wherein said imperfect unhulled grains comprise discolored unhulled grains and said perfect unhulled grains comprise properly colored unhulled grains.

9. The apparatus of claim 1 wherein said imperfect grains comprise chalky unhulled grains and said perfect grains comprise non-chalky unhulled grains.

10. The apparatus of claim 1 wherein said separation section having a first angled section and a second angled section connected to said first angled section at an angle closer to vertical than said first angled section.

11. The apparatus of claim 1 wherein said stabilizing section having a curve, said curve exerting a centrifugal force on said grains passing through said analyzing area.

12. The apparatus of claim 1 wherein said grains having a length and a belly, wherein said chute having a bottom, and wherein said chute further having a V or U shaped cross-section and an H shaped cross-section, said V or U shaped cross-section orientating the length of said grains parallel to said chute path, and said H shaped cross-section orientating said belly of said grains on said bottom of said chute.

13. The apparatus of claim 1 wherein said chute further having a coating.

14. The apparatus of claim 1 wherein said analyzing section being located on said chute or subsequent to said end of said chute.

15. An apparatus for sorting internally cracked unhulled rice from internally whole unhulled rice, comprising:

a chute for defining a path for said unhulled grain, said chute having an end, a coating, a separation section and a stabilizing section, said separation section having a first angled section and a second angled section connected to said first angled section at an angle closer to vertical than said first angled section, and wherein said stabilizing section of said chute having a curve, said curve exerting a centrifugal force on said unhulled rice passing along said stabilizing section;

an analyzing area being positioned subsequent to said end of said chute;

a light means having a laser line, said laser line being transmitted through said unhulled rice passing through said analyzing section;

a light detection means having an outer shell, a lens, and a photo detector, wherein said an outer shell defining a slit, said slit being positioned to receive said laser line transmitted through said unhulled rice and into said outer shell, said lens having a focal point being positioned in said outer shell for receiving said laser line entering said outer shell and for focusing said laser line at said focal point, and a photo detector being positioned in said outer shell at said focal point;

an analyzing means for determining internally cracked unhulled rice from internally whole unhulled rice, said analyzing means being coupled to said light detection means;

a separating means for separating internally cracked unhulled rice from whole unhulled rice, said separating means having an air nozzle blowing either internally cracked unhulled rice or internally whole unhulled rice out of said analyzing area, said separating means being coupled to said analyzing means.

16. A method for sorting imperfect grains from perfect grains, comprising the steps of:

aligning said grains in the longitudinal path of a chute;

creating distance between individual grains in an inclined section of said chute;

stabilizing grains in said chute with centripetal force for optical detection;

optically analyzing said grains with a laser line and producing an output;

determining from said output of said optical analysis if said grains are perfect or imperfect; and separating said imperfect grains from said perfect grains.

17. The method of claim 16 wherein said optical analyzing step comprises:

directing a laser through a cylindrical lens to create a laser line;

transmitting a laser line through said grains onto a photo detector; and receiving the transmitted laser line on the photo detector.

18. The method of claim 16 wherein said imperfect grains comprise internally cracked unhulled grains, and wherein said perfect grains comprise internally whole unhulled grains.

19. The method of claim 16 wherein said imperfect grains comprise discolored unhulled grains, and wherein said perfect grains comprise properly colored unhulled grains.

20. The method of claim 16 wherein said imperfect grains comprise chalky unhulled grains, and wherein said perfect grains comprise non-chalky unhulled grains.

21. The method of claim 16 wherein said aligning step comprises orientating the length of said grains parallel to said path of said chute and orientating the belly of said grains on the bottom of said chute.

22. The method of claim 16 further comprising the step of directing said perfect grains to a white rice miller.

23. The method of claim 16 further comprising the step of directing said imperfect grants to a parboil rice miller.

* * * * *